US005653613A

United States Patent [19]

Shimoda

[11] Patent Number: 5,653,613

[45] Date of Patent: Aug. 5, 1997

[54] ELECTRIC CONNECTOR AND HOUSING OF THE ELECTRIC CONNECTOR

[75] Inventor: Keizou Shimoda, Aichi, Japan

[73] Assignee: Kabushiki Kaisha Tokai Rika Denki Seisakusho, Niwa-gun, Japan

[21] Appl. No.: 538,131

[22] Filed: Oct. 2, 1995

[30] Foreign Application Priority Data

Oct. 3, 1994 [JP] Japan ..... 6-239293

[51] Int. Cl.[6] ..... H01R 13/514

[52] U.S. Cl. ..... 439/752; 439/752.5

[58] Field of Search ..... 439/752, 752.5, 439/746, 747, 748, 749, 595

[56] References Cited

U.S. PATENT DOCUMENTS 5,066,252 11/1991 Kato et al. ..... 439/752

5,464,356 11/1995 Nebeshima et al. ..... 439/752

*Primary Examiner*—Neil Abrams

*Assistant Examiner*—T. C. Patel

*Attorney, Agent, or Firm*—Morgan, Lewis and Bockius LLP

[57] ABSTRACT

An electric connector including a housing, at least one terminal reception chamber formed in the housing for receiving a terminal, a flexible member provided in the terminal reception chamber so as to serve as a primary locking portion which permits only insertion of the terminal and which engages with a primary engagement portion formed on the terminal to thereby lock the terminal from coming off, a retainer fitted to a fitting groove formed in an upper surface of the housing, and a secondary locking portion formed in the retainer and having a locking piece which is arranged so as to project into the terminal reception chamber when the retainer is fitted to the housing and engage with a secondary engagement portion of the terminal to thereby lock the terminal from coming off, wherein the fitting groove is provided so as to extend to a side wall surface of the terminal reception chamber which is located on at least one side portion of the housing; and the secondary engagement portion has a pair of engagement pieces, and the secondary locking portion located on at least one side portion of the retainer is fitted into the fitting groove extended to the one side portion of the retainer so that the secondary locking portion locks one of the pair of engagement pieces located on the side wall surface side when the terminal is fitted into the terminal reception chamber, the secondary locking portion forming a part of the side wall of the housing.

6 Claims, 5 Drawing Sheets

ELECTRIC CONNECTOR AND HOUSING OF THE ELECTRIC CONNECTOR

BACKGROUND OF THE INVENTION

1. Field of the Invention

This invention relates to electric connectors for connecting cords constituting electric circuits and particularly relates to an electric connector and an electric connector housing which has a structure for multistageously locking terminals mounted on one-end portions of cords from coming off.

2. Background

As electric connectors (hereinafter simply referred to as "connectors") used for connecting cords constituting electric circuits, there is such a known electric connector as shown in FIGS. 5 and 6. The connector 30 is a male connector which is fitted into a female connector not shown in the drawings so that cords fitted into the two male and female connectors respectively are electrically connected to each other through the two connectors.

Terminals 35 mounted on one-end portions of cords 34 respectively are primarily locked by flexible lances 33 formed in terminal reception chambers 32 of a housing 31 of the connector 30. That is, when the terminals 35 is to be inserted into the terminal reception chambers, the lances 33 are bent to permit insertion of the terminals 35. Further, hook portions 33*a* of the lances 33 are fitted into engagement concave portions 36 of the terminals 35 so that the terminals 35 are locked so as to be prevented from coming off.

In addition to the primary locking by the lances 33, the terminals 35 are secondarily locked by a retainer 37 which is provided as a separate member so as to be fitted into the housing 31. That is, the retainer 37 has a comb-liken upper surface and the housing 31 also has a comb-like upper surface so that the retainer 37 is fitted into fitting grooves 38 which are formed from the upper surface of the housing 31 to the terminal reception chambers 32 so that the fitting grooves 38 communicate with the terminal reception chambers 32. When the retainer 37 is fitted into the fitting grooves 38, secondary locking portions 39 formed on, the lower surface of the retainer 37 so as to project are inserted into secondary locking portion reception grooves 38*a* of the fitting grooves 38 which are formed in the side of a pair of upper and lower terminal reception chambers 32. On the other hand, each of the secondary locking portions 39 has a pair of upper-and lower locking pieces 40 which project so as to be inserted into a stabilizer 41 having two pieces 41*a* and 41*b* formed on opposite edge portions of the upper surface of a corresponding terminal 35, in each of the terminal reception chambers in the upper and lower stages. Accordingly, the pieces 41*a* and 41*b* of the stabilizer 41 are engaged with the locking pieces 40 so that the stabilizer 41 is locked to thereby prevent the terminal 35 from coming off. By the aforementioned primary and secondary locking means, the terminals 35 can be securely prevented from dropping out of the connector 30.

In the case where the cords 34 are to be wired in a narrow place, it may be however required that the size of the connector 30 is reduced to be as small as possible to thereby save space.

To reduce the size of the connector 30 to satisfy the aforementioned requirement, a measure shown in FIG. 7 is conventionally taken. That is, the structure of the secondary locking portions 39*a* located in opposite end portions of the retainer 37 is removed from the conventional connector shown in FIGS. 5 and 6 to thereby narrow the width of the retainer 37 as shown as a retainer 43 in FIG. 7. With the reduction of the width of the retainer, space for receiving the structure of the secondary locking portions 39*a* becomes unnecessary with respect to the terminal reception chambers 45*a* located in opposite side portions of the housing 44. Accordingly, compared with the connector shown in FIGS. 5 and 6, the side wall of the housing 44 can be reduced by the thickness of the secondary locking portions 39*a*. With the reduction of the side wall of the housing 44, the whole width of the connector 42 is reduced as a measure to reduce the size.

The retainer 43 of the small-sized connector shown in FIG. 7 is however configured so that the secondary locking portions 39*a* located in opposite end portions of the retainer 37 of FIG. 5 are removed from the retainer 37. That is, in the terminal 35 inserted into each of upper and lower terminal reception chambers 45*a* located in the opposite sides of the connector 42, only one stabilizer piece 41*a* located in the inner side is locked by a corresponding locking piece 40 in the direction against escaping but the other stabilizer piece 41*b* on the outer side is not locked. Accordingly, the secondary locking force given to the terminals 35 inserted into these terminal reception chambers 45*a* are weakened, so that a problem arises in that the strength for preventing the terminals from coming off is reduced compared with the terminals 35 inserted into the other terminal reception chambers 45.

SUMMARY OF THE INVENTION

The present invention has been attained to solve the problems in the conventional art and it is an object thereof to provide an electric connector and a housing therefor, in which reduction in size is attained without reducing the strength for preventing the terminals from coming off.

To achieve the foregoing object, according to a first aspect of the present invention, there is provided an electric connector which comprises: a housing; at least one terminal reception chamber formed in the housing for receiving a terminal mounted on an end portion of electric wire; a flexible member provided in the terminal reception chamber so as to serve as a primary locking portion which permits only insertion of the terminal and which engages with a primary engagement portion formed on the terminal to thereby lock the terminal from coming off; a retainer fitted to a fitting groove formed in an upper surface of the housing; a secondary locking portion formed in the retainer and having a locking piece which is arranged so as to project into the terminal reception chamber when the retainer is fitted to the housing and engage with a secondary engagement portion of the terminal to thereby lock the terminal from coming off; the fitting groove being provided so as to extend to a side wall surface of the terminal reception chamber which is located on at least one side portion of the housing; the secondary engagement portion having a pair of engagement pieces; and the secondary locking portion being located on at least one side portion of the retainer is fitted into the fitting groove extended to the one side portion of the retainer so that the secondary locking portion locks one of the pair of engagement pieces located on the side wall surface side when the terminal is fitted into the terminal reception chamber, the secondary locking portion forming a part of the side wall of the housing.

In the first aspect of the present invention, the terminal inserted into the terminal reception chamber of the housing is primarily locked by the flexible member. The retainer is fitted to the housing, so that the locking piece formed on the secondary locking portion of the retainer projects into the terminal reception chamber to thereby lock the terminal so as not to coming off. In this aspect of the present invention, engagement grooves corresponding to the secondary locking portions located on the opposite sides of the retainer are formed in the opposite side walls of the housing. Accordingly, the secondary locking portions on the opposite sides of the retainer are received in the opposite side walls of the housing. That is, the secondary locking portions located in the opposite sides of the retainer constitute part of the side walls of the housing, so that it becomes unnecessary or little necessary to keep a space for receiving the secondary locking portions in the terminal reception chambers located on the opposite sides of the housing. Accordingly, a measure to reduce the size of the electric connector can be taken without reducing the strength for preventing the terminals from coming off.

Preferably, the fitting groove is provided so as to extend to the opposite side walls of a body of the housing. In the present invention, the secondary locking portions located on the opposite sides of the retainer constitute part of opposite side walls of the housing, so that the size of the electric connector can be reduced more greatly compared with the connector having the same structure provided only in the one side wall of the housing.

Preferably, a plurality of terminal reception chambers are formed in the housing so that a plurality of terminals are to be inserted into the terminal reception chambers respectively. In the present invention, the housing has a plurality of terminal reception chambers so that a plurality of cords can be connected to each other at the same time.

Preferably, the flexible member has a base end portion extending in a terminal insertion side of the housing so that the extending base end portion forms an insertion direction limiting means for limiting the direction of insertion of each terminal correspondingly to the secondary engagement portion of the terminal. In the present invention, the direction of insertion of the terminals can be prevented from being mistaken.

According to another aspect of the present invention, an electric connector housing has a fitting groove formed in its upper surface so that a retainer is to be fitted into the fitting groove, wherein a notch is provided at least one side wall of the housing so as to form a fitting groove into which a secondary locking portion located on at least one side portion of the retainer is to be fitted.

DETAILED DESCRIPTION OF THE PREFERRED EMBODIMENT

Figure 1:
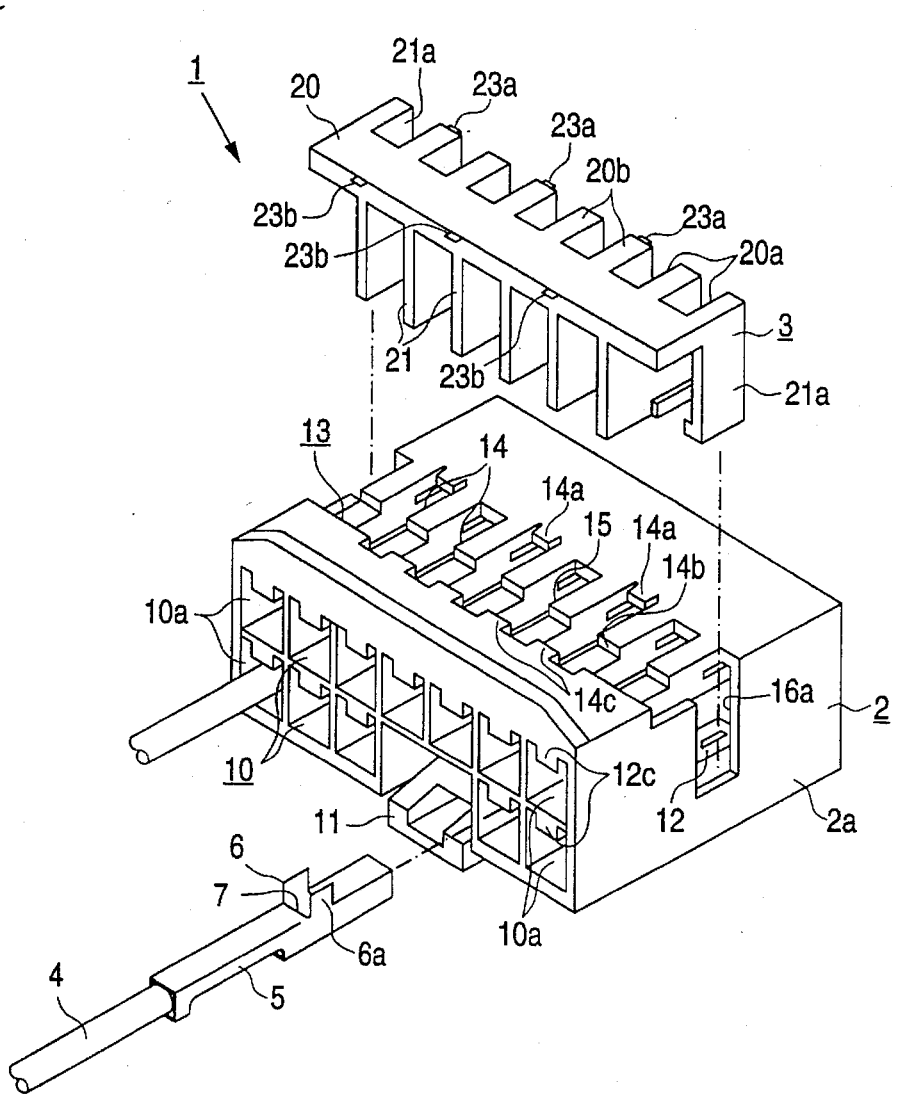
FIG. 1 is an exploded perspective view of an embodiment of the connector according to the present invention.

An embodiment of the present invention will be described with reference to the drawings.

As shown in FIGS. 1 to 4, a connector 1 of this embodiment is a male connector of resin which can be fitted into a female connector not shown so that cords as electric wires fitted into the two connectors respectively are connected to each other electrically. The connector 1 is constituted by a housing 2, and a retainer 3 fitted into the housing 2, and is designed so that terminals 5 mounted on one-end portions of the cords 4 are locked doubly. Each of the terminals 5 is formed by bending a metal plate into a shape of a substantially rectangular tube. Each of the terminals 5 is fitted into naked wire at a front end of a corresponding cord 4 and caulked. A stabilizer 6 as a secondary engagement portion is formed by cutting an upper surface portion, on the front end side, of the terminal 5 so as to be erected vertically at edges on the opposite side portions of the terminal 5. As a result, a through hole is formed in the upper surface of the terminal between two stabilizer pieces of the stabilizer 6. The through hole forms an engagement concave portion 7 as a primary engagement portion.

The housing 2 is shaped like a cube in external appearance. Terminal reception chambers 10 are formed through the housing 2 from the front to the rear and each of the chambers 10 is shaped nearly rectangular in cross-section. That is, the chambers 10 are formed as a matrix of 2 lines and 7 columns in the housing 2. Incidentally, no terminal reception chambers 10 are formed at places in the lower line of the third and fourth columns in the housing 2 from the right of FIG. 2. That is, the structure of the terminal reception chambers 10 at these places are omitted to form a space there so that a flexible engagement member 11 capable of being engaged with a corresponding locking portion of a female connector not shown is formed so as to be used for fitting the so-called male connector 1 of this embodiment to the housing of the separate female connector. Accordingly, the number of terminal reception chambers 10 provided in the housing 2 is 12 in total. Hereinafter, in this specification, the side of the housing 2 in which the terminals 5 are inserted into the terminal reception chambers 10 of the housing 2 will be referred to as "insertion side", and the side of the housing 2 in which the male connector 1 is fitted into the female connector (not shown) will be referred to as "fitting side".

Figure 4:
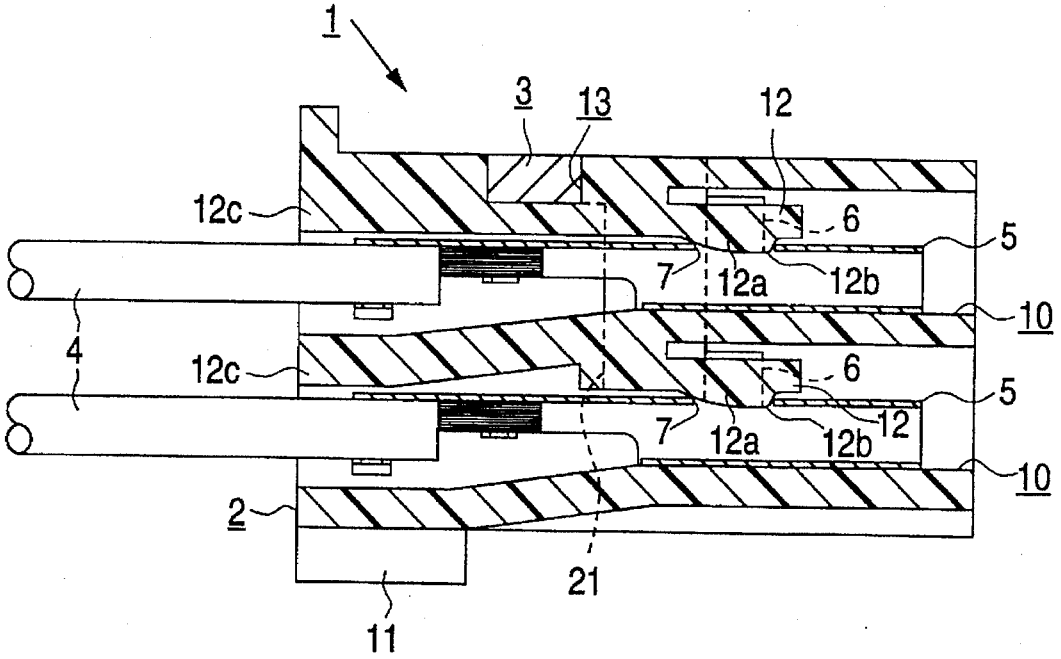
FIG. 4 is a vertical sectional view of the same connector.

As shown in FIG. 4, in the insertion side, on the upper surface of the inner circumference of each terminal reception chamber 10, a lance 12 as a flexible member constituting a primary locking portion is formed integrally so as to extend toward the fitting side. A hook portion **12*a* is formed at an end portion of the lance 12. The hook portion 12*a* has a gentle slope in the direction of insertion of the terminal 5 to thereby permit the insertion of the terminal 5. A step portion 12*b* is formed so as to be opposite to the slope. The step portion 12*b* corresponds to the engagement concave portion 7 of the terminal 5 so that the terminal 5 is locked by the step portion 12*b* so as to be prevented from coming off. Further, the base end portion of the lance 12 is provided so as to extend to the insertion side to thereby form a guide projection 12*c*. If the stabilizer 6 of a terminal 5 is not fitted onto the projection 12*c* when the terminal 5 is to be inserted, the insertion of the terminal 5 is not permitted, that is, erroneous turning upside down between the upper and lower surfaces of the terminal is prevented when the terminal 5** is inserted.

Figure 2:
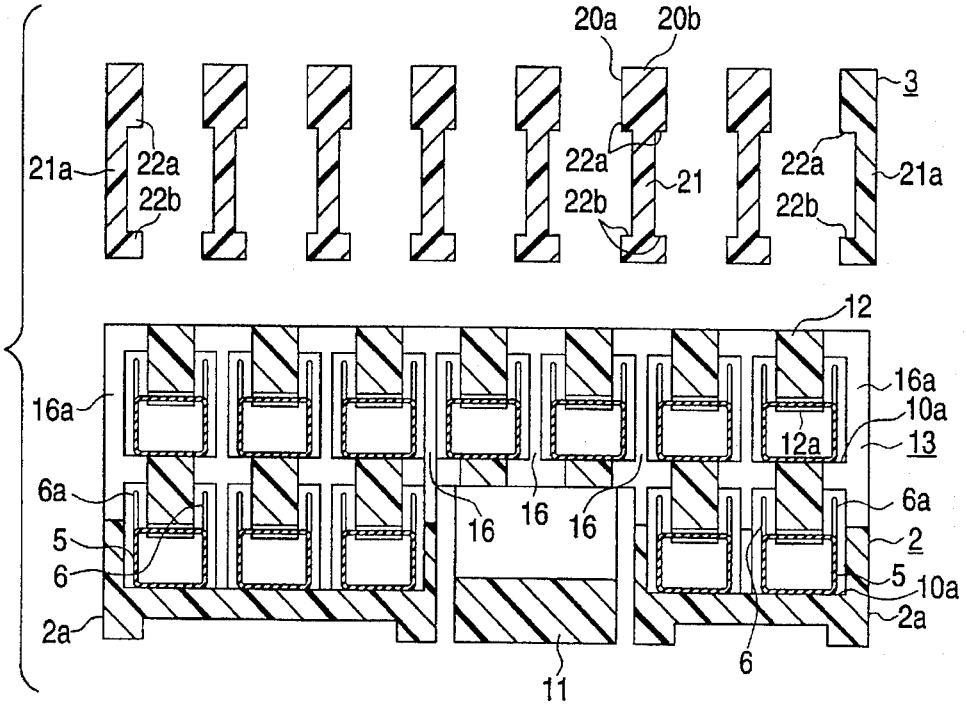
FIG. 2 is an exploded cross-sectional view of the same connector showing a state before the retainer is fitted.
Figure 3:
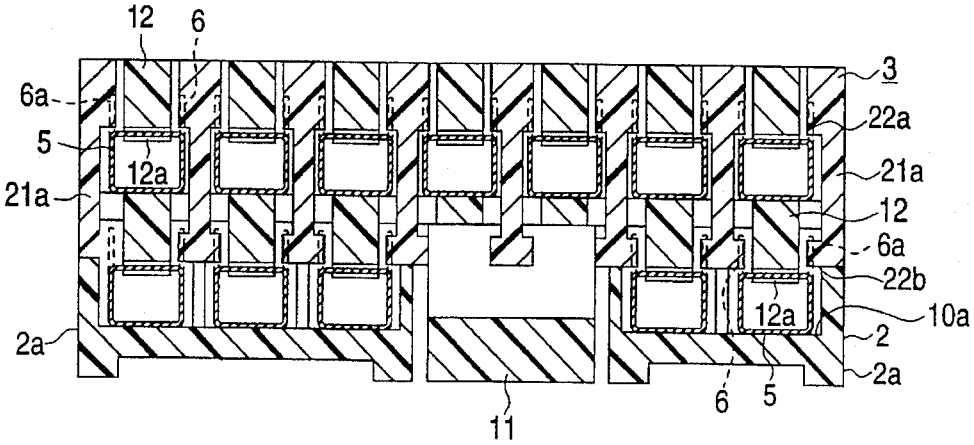
FIG. 3 is a cross-sectional view of the same connector showing a state after the retainer is fitted.

As shown in FIGS. 1 to 3, the housing 2 has fitting grooves 13 in which the retainer 3 is fitted or fixed. That is, the fitting grooves 13 are provided with slits 14 which extend in the upper surface of the housing 2 from the insertion side to the fitting side and between the respective upper terminal reception chambers 10 (in the case of the terminal reception chambers 10*a* on the opposite sides of the housing 2, the slits 14 are formed in the upper edge ends of the respective side walls 2*a* of the housing 2). The upper surface of the lance 12 is lowered by one step toward the insertion side of the housing 2 (concave portion 14*b*) so that the slits 14 communicate with one another. Thus, the slits 14 are formed so as to have comb-like grooves 15 as a whole in its upper view. In the comb-like grooves 15, projections 14*a* are formed at end portions of the slits 14, respectively. Further, similarly, projections 14*c* are formed at insertion side inner edges of the concave portions 14*b*.

In the comb-like grooves 15, the slits 14 are provided so that the side walls of the upper terminal reception chambers 10 are cut away and that the slits 14 are led to the opposite edges of the upper walls of the lower terminal reception chambers 10. The grooves formed so that the slits 14 communicate with the upper and lower terminal reception chambers 10 in the housing 2 are made secondary locking portion reception grooves 16 in the fitting grooves 13.

Further, in this embodiment, secondary locking portion reception grooves 16a located in opposite sides of the housing 2 in the fitting grooves 13 are formed by notching part of the side walls 2*a* of the housing 2 from the upper terminal reception chamber 10 to the vicinity of the upper portion of the lower terminal reception chamber 10.

In the retainer 3, a plurality of teeth 20*a* are formed at one edge end portion of a plate-like retainer body 20 to form a comb-like upper surface. In the lower surfaces of portions corresponding to comb teeth 20 in the retainer 3, plate-like secondary locking portions 21 are integrally provided so as to extend downward. Secondary locking portions 21*a* located in the opposite sides of the retainer 3 are narrower in width than other secondary locking portions 21, correspondingly to the secondary locking portion reception grooves 16*a* formed in the side walls 2*a* of the housing 2. On the base end portion and front end portions of each of the secondary locking portions 21, locking pieces 22*a* and 22*b* are integrally provided so as to extend in the same direction as each tooth 20*a*. More specifically, in the secondary locking portions 21*a* located in the opposite sides, a pair of locking pieces 22*a* and 22*b* are formed only on the inside while in each of the other secondary locking portions 21, a pair of locking pieces 22*a* and 22*b* are formed on each of the opposite sides. Projections 23*a* are formed respectively at the ends of the teeth 20*a* of the retainer 3, and projections 23*b* are similarly formed at the insertion side edge ends of the retainer 20.

Next, the procedure for inserting the terminals 5 of the cords 4 into the connector 1 will be described.

First, each of the terminals 5 of the cords 4 is inserted with its stabilizer 6 put upside. If, in this case, any terminals 5 is inserted in a state turned upside down compared with the state shown in FIG. 1, the corresponding guide projection 12*c* cannot be fitted between the stabilizer pieces 6*a* so that the insertion of this terminal 5 is not permitted.

As shown in FIG. 4, the terminal 5 inserted in correct position (the state shown in FIG. 1) is further permitted to be inserted by bending the lance 12. When the terminal 5 is inserted up to a predetermined position, the lance 12 is restored to its original position in a stake where the hook portion 12*a* is located in the engagement concave portion 7 so that the hook portion 12*a* is fitted into the engagement concave-portion 7. As a result, the step portion 12*b* of the hook portion 12*a* fitted into the engagement concave portion 7 strikes on the fitting side edge end of the engagement concave portion 7 to lock the terminal 5 so that the terminal 5 is prevented from coming off (primary locking).

Then, as shown in FIGS. 1 to 4, the retainer 3 is fitted into the fitting grooves 13 of the housing 2. In this occasion, the teeth 20*a* of the retainer 3 are fitted into the slits 14 of the fitting grooves 13 respectively, the retainer body 20 is fitted into the concave portions 14*b* communicating with the slits 14, and the secondary locking portions 21 are fitted into the secondary locking portion reception grooves 16 leading the slits 14 to the upper and lower terminal reception chambers 10. In this occasion, the projections 23*a* and 23*b* of the retainer 3 are engaged with the projections 14*a* and 14*c* of the housing 2 respectively, so that the retainer 3 is fixed to the housing 2.

As shown in FIGS. 3 and 4, the upper and lower locking pieces 22*a* and 22*b* formed on the secondary locking portions 21 of the retainer 3 fitted and fixed to the housing 2 are arranged so as to project on the insertion side of the stabilizers 6 of the terminals 5 inserted into the upper and lower terminal reception chambers 10, respectively. Accordingly, even if a person tries to move the terminals 5 in the escaping direction, the locking pieces 22*a* and 22*b* lock the respective stabilizers 6 to thereby prevent the terminals 5 from coming off (secondary locking).

Figure 5:
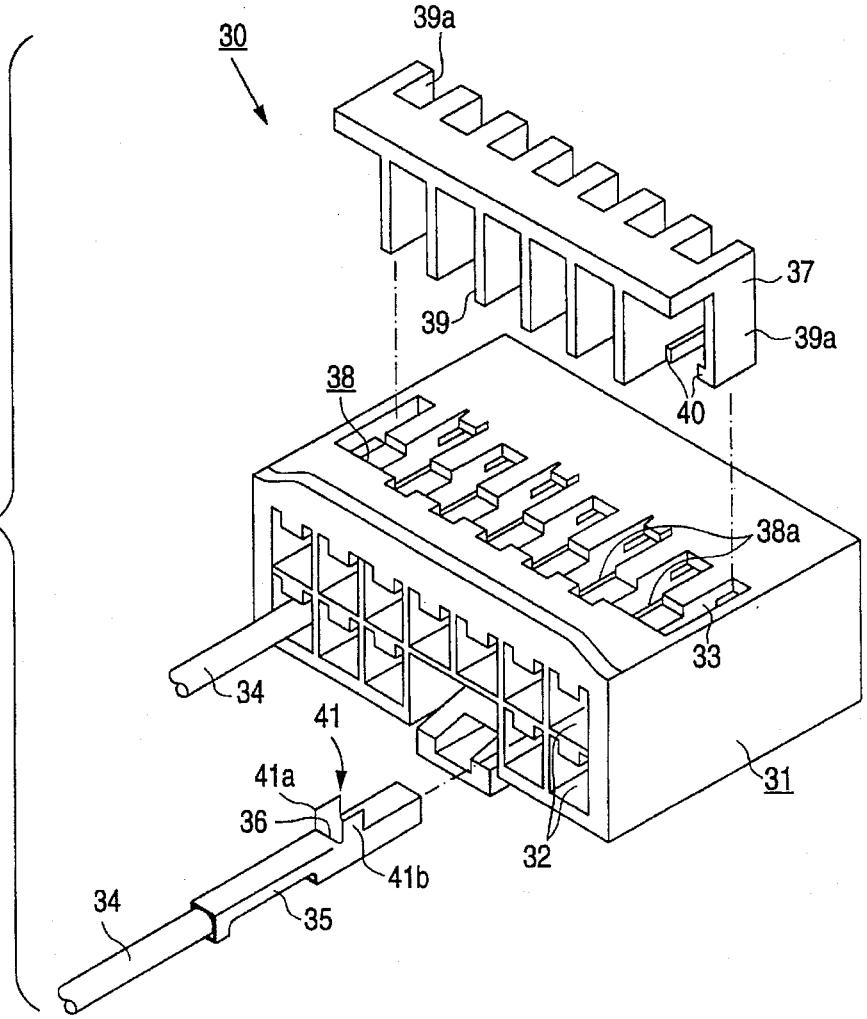
FIG. 5 PRIOR ART
FIG. 5 is an exploded perspective view of a conventional connector.
Figure 6:
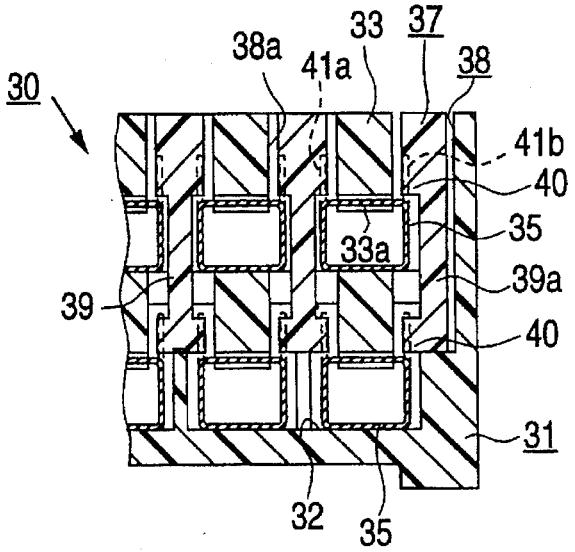
FIG. 6 PRIOR ART
FIG. 6 is a partly cross-sectional view of the connector.
Figure 7:
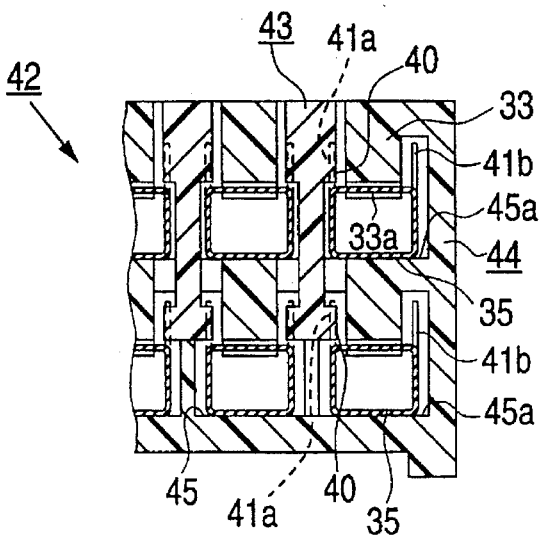
FIG. 7 PRIOR ART
FIG. 7 is a partly cross-sectional view of another conventional connector.

This embodiment is different from the conventional art shown in FIG. 7 in which on the opposite sides of the retainer 3, there are provided secondary locking portions 21*a* for locking the outer side stabilizer pieces 6*a* of the terminals 5 fitted into the terminal reception chambers 10*a* located on the opposite sides of the housing 2. Accordingly, the escaping strength of the terminals 5 fitted into the terminal reception chambers 10*a* on the opposite sides is not lowered compared with the terminals 5 fitted into the other terminal reception chambers 10. Furthermore, the secondary locking portions 21*a* located on the opposite sides of the retainer 3 are fitted into the secondary engagement portion reception grooves 16*a* on the opposite sides which are formed by notching the side walls 2*a* of the housing 2, so that the secondary locking portions 21*a* are put within the widths of the secondary engagement portion reception grooves 16*a* respectively (the locking pieces 22*a* and 22*b* project into the terminal reception chambers 10). That is, the secondary locking portions 21*a* located on the opposite sides of the retainer 3 are fitted into the side walls 2*a* of the housing 2 to thereby form part of the side walls 2*a*. Accordingly, this embodiment is different from the conventional art as shown in FIGS. 5 and 6 in the point that the width for receiving the secondary locking portions 21*a* located on the opposite sides of the retainer 3 does not need to be secured in the terminal reception chambers 10*a* located on the opposite sides of the housing 2. Consequently, the side walls 2*a* of the housing 2 can be made thin.

As described above, a measure to reduce the size of the connector 1 can be taken without lowering the escaping strength of the terminals 5.

Further, in the conventional art shown in FIG. 7, cost increases because a mold for molding the housing 44 and retainer 43 needs to be prepared separately with respect to the connector 30 of FIG. 5 for the purpose of reducing the size of the connector 42. In this embodiment, however, the cost of the mold is reduced because the shape of the retainer 3 is the same as that of the retainer 37 shown in FIG. 5 so that the mold used for the retainer 37 can be also used for the retainer 3.

Changes or modifications may be made as follows without departing from the spirit of the present invention.

(1) Although the aforementioned embodiments have shown the case where the present invention is embodied in a male connector 1, the present invention may be carried out in a female connector which is to be fitted to the male connector 1.

(2) The number, arrangement and structure of the terminal reception chambers 10 may be changed suitably, so that a plurality of cords can be connected at the same time.

(3) The opposite side walls of the retainer 3 of the aforementioned embodiments may be made thinner so that the opposite side walls are located in the inner side than the side wall surfaces of the housing.

(4) The engagement member 11 used for engagement with the female Connector may be configured so as to be disposed in the outside of the housing 2. That is, for example, in the aforementioned embodiments, the terminal reception chambers 10 may be formed in a matrix of two rows and seven columns so as to have 14 chambers in total, (5) Only one side wall of the housing 2 may be notched to form a fitting groove 13 corresponding to only one secondary locking portion 21*a* located at one end portion of the retainer 3 whereas the other side wall 2*a* may be thickened so that a space for receiving a secondary locking portion 21*a* located in the other end portion of the retainer 3 is formed in the inside of the thick side wall 2*a*. That is, the thickness of the other side wall of the housing 2 becomes equal to the thickness the of the conventional housing shown in FIG. 6.

What is claimed is:

1. A connector, comprising:

a housing having a plurality of terminal reception chambers provided therein, each of the plurality of terminal reception chambers for receiving a terminal connected to a wire;

a flexible member provided in each of the terminal reception chambers and having a primary locking portion to engage with a primary engagement portion formed on the respective terminal;

a retainer;

a plurality of secondary locking portions disposed on said retainer, each one of the plurality of secondary locking portions having a locking piece projected into a respective terminal reception chamber to engage with a secondary engagement portion of said terminal; and a plurality of slits formed in an upper surface of said housing and at least one of said slits extended through a side wall of said housing, wherein when said retainer is fit into said housing, each one of said secondary locking portions are received into a respective slit, and one of said secondary locking portions of said retainer is received into said one of said plurality of slits extended through said side wall of said housing.

2. The connector of claim 1, further comprising a firing groove is extended to opposite side walls of said housing, wherein said slits are disposed in the fitting groove, and wherein secondary locking portions of both sides of said retainer fit into slits extended through opposite side walls of said housing.

3. The connector of claim 1, wherein said retainer has an engaging projection to engage a protrusion formed on an opening of said housing.

4. A connector, comprising:

a housing having a plurality of terminal reception chambers provided therein, each of the plurality of terminal reception chambers for receiving a terminal connected to a wire;

a flexible member provided in each of the terminal reception chambers and having a primary locking portion to engage with a primary engagement portion formed on the respective terminal;

a retainer;

a plurality of secondary locking portions disposed on said retainer, each one of the plurality of secondary locking portions having a locking piece projected into a respective terminal reception chamber to engage with a secondary engagement portion of said terminal; and a plurality of slits formed in an upper surface of said housing and at least one of said slits extended through a side wall of said housing, wherein when said retainer is fit into said housing, each one of said secondary locking portions are received into a respective slit, one of said secondary locking portions of said retainer being received into said one of said plurality of slits extended through said side wall of said housing, and wherein each one of said secondary locking portions define a side portion of said respective terminal reception chamber.

5. The connector of claim 4, further comprising a fitting groove extended to opposite side walls of said housing, wherein said slits are disposed in the fitting groove, and wherein secondary locking portions of both sides of said retainer fit into slits extended through opposite side walls of said housing.

6. The connector of claim 4, wherein said retainer has an engaging projection to engage a protrusion formed on an opening of said housing.

* * * * *

UNITED STATES PATENT AND TRADEMARK OFFICE

CERTIFICATE OF CORRECTION

PATENT NO. : 5,653,613

DATED : August 5, 1997

INVENTOR(S) : Shimoda et al.

It is certified that error appears in the above-identified patent and that said Letters Patent is hereby corrected as shown below:

Column 8, Line 3, change "firing" to --fitting--.

Signed and Sealed this

Second Day of February, 1999

*Attest:*

*Attesting Officer*

*Acting Commissioner of Patents and Trademarks*